United States Patent [19]

Pinkerton et al.

[11] Patent Number: 4,755,003

[45] Date of Patent: Jul. 5, 1988

[54] CUTTER BIT ASSEMBLY WITH RESILIENT BIT RETAINER

[76] Inventors: Cletis P. Pinkerton, 7785 Mountain Ash Dr.; Robert L. Morris, 1329 Riverside Dr., both of Mentor, Ohio 44060

[21] Appl. No.: 942,688

[22] Filed: Dec. 17, 1986

[51] Int. Cl.[4] ..... E21C 25/10

[52] U.S. Cl. ..... 299/86; 299/91

[58] Field of Search ..... 299/91, 92, 86, 79; 24/297, 17 AP; 37/242 R, 242 A

[56] References Cited

U.S. PATENT DOCUMENTS

| | | | |
|---|---|---|---|
| 3,205,759 | 9/1965 | Texier | 24/297 X |
| 3,246,440 | 4/1966 | Meyer | 24/297 |
| 3,254,922 | 6/1966 | Krekeler | 37/142 A X |
| 4,149,753 | 4/1979 | Stoltz et al. | 299/91 |
| 4,462,638 | 7/1984 | Den Besten | 299/86 |
| 4,582,364 | 4/1986 | de Mey | 299/92 |

FOREIGN PATENT DOCUMENTS

| | | | |
|---|---|---|---|
| 2757510 | 6/1979 | Fed. Rep. of Germany | 299/92 |
| 2105768 | 3/1983 | United Kingdom | 299/79 |

*Primary Examiner*—Stephen J. Novosad
*Assistant Examiner*—David J. Bagnell
*Attorney, Agent, or Firm*—Watts, Hoffman, Fisher & Heinke Co.

[57] ABSTRACT

The present invention relates to a cutter bit assembly of the type for use utilized in excavating machines such as in mining, road scarifying, concrete cutting and the like. More specifically, the invention relates to such assembly including a mounting block member having an axial bore extending therethrough adapted to rotatably receive a cutter bit member, and with a polymeric retainer member for preventing axial dislodgment of the cutter bit member during use thereof.

15 Claims, 3 Drawing Sheets

CUTTER BIT ASSEMBLY WITH RESILIENT BIT RETAINER

TECHNICAL FIELD

The present invention relates to a cutter bit assembly of the type for use utilized in excavating machines such as in mining, road scarifying, concrete cutting and the like. More specifically, the invention relates to such assembly including a mounting block member having an axial bore extending therethrough adapted to rotatably receive a cutter bit member, and with a polymeric retainer member for preventing axial dislodgment of the cutter bit member during use thereof.

BACKGROUND OF THE INVENTION

The present invention relates to a cutter bit assembly of the type utilized for excavating machines. As employed herein the term "excavating machine" includes mining machines, road scarifying machines, concrete cutting machines and the like. The present invention is concerned with a retainer system incorporating a hollow, cap-like retainer made from a polymeric material with adapted to be detachably connected to the terminal free-end of the cutter bit shank so as to prevent axial dislodgment of the shank and hence, the cutter bit upon excavating use thereof. A typical prior art retainer, for example, disclosed in U.S. Pat. No. 3,820,848 wherein a conventional type C-ring or hog ring is utilized to retain the cutter bit in the mounting block. As known in the art, this retainer ring construction is intended to limit movement of the cutter bit in an axial direction relative to the mounting block.

The present invention has particular application with cutter bit assemblies wherein the cutter bit has a generally conically shaped nose portion and an elongated, reduced diameter cylindrical shank portion, and with the shank portion being adapted to be disposed for rotatable movement within the corresponding axial bore in the mounting block. When the excavating machine is in operation, it has been official that the bits rotate in the bore or socket provided in the mounting block. This allows a wear upon the bit and the carbon insert (carbide) to be distributed generally evenly allowing the bit to retain its symmetry thereby providing substantially continuous sharpness of the bit and carbide insert during operation thereof. Recently, there has been provided a generally, resilient wear sleeve retainer element that is disposed between the shank of the bit and the bore or socket of the mounting block wherein the bit is allowed to rotate within the wear sleeve which is frictionally held on the inside wall of the bore or socket while retaining the cutter bit in its properly oriented working position on a excavating wheel, for example. Such an assembly is disclosed in U.S. Pat. No. 4,201,421.

Herefore, difficulties have been encountered in an effort to rotatably mount the cutter bit with prior retainer systems. Systems snap-type retainers are not completely effective for minimizing the wear on the back of the mounting block to the point where the tools develope a substantial amount of freedom of movement in the axial direction in the mounting block. Also, such prior snap-ring retainers generally require a special snap-ring tool for assembly and disassembly and are relatively costly to produce.

This application is related to Applicants co-pending application Ser. No. 610,618 filed May 16, 1984 wherein various retainer systems are disclosed in conjunction with a new and improved conical bit having a generally mushroom-shaped nose portion.

SUMMARY OF THE INVENTION

It is a primary object of the present invention to provide a cutter bit assembly of the type for use with an excavating machine that incorporates a new and novel retainer system for preventing dislodgment of the cutter bit member during use thereof. The retainer system incorporates a retainer member having a hollow, cap-like construction made from a high strength polymeric material. The retainer member includes, when formed, a cavity adapted to be fitted around the terminal free-end of the cutter bit shank, and has protuberance means integrally formed therewith and extending radially inwardly for coacting friction engagement with the confronting surface of the cutter bit shank to prevent axial dislodgment of the cutter bit shank from the bore or socket in the mounting block during use thereof. The protuberance means include, in one form, two or more protuberance portions formed from the polymeric material of the cap-like body and each having one or more rib elements extending radially inwardly toward the cutter bit shank in the installed position. Preferably, each rib element includes a base portion and a apex portion with the apex portion adapted, if desired, to be sheard-off upon coacting gripping engagement with the confronting surface of the cutter shank portion.

Accordingly, the present invention provides an improved retainer system for the cutter bit assembly that incorporates a unitary, generally cap-like member having a hollow construction and made from a polymeric material that is of a simple, yet rugged construction, and that can be quickly and easily assembled and disassembled in the field with relatively little time and effort and without the need for special tools for assembly and disassembly of the component parts.

These and other advantages and objects of the present invention will be appreciated as the following description proceedes when taken in conjunction with the accompanying drawings.

BEST MODE FOR CARRYING OUT THE INVENTION

Figure 1:
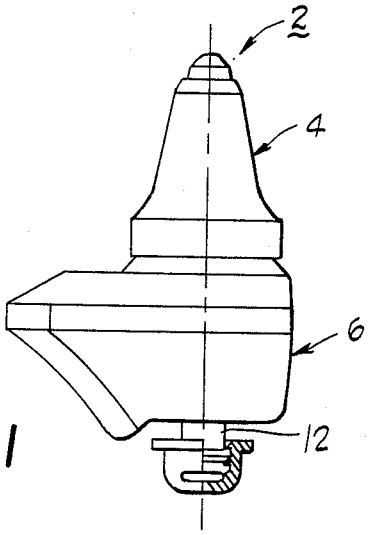
FIG. 1 is an exploded view of the cutter bit assembly of the present invention.
Figure 2:
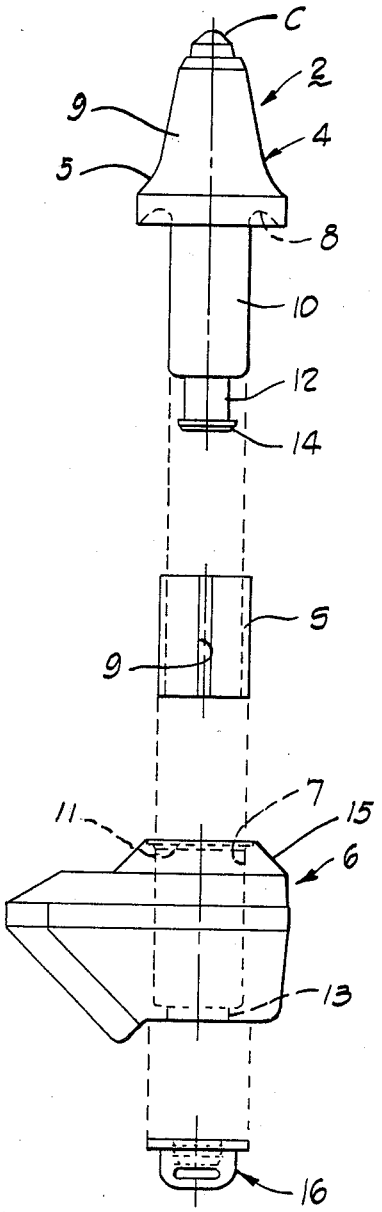
FIG. 2 is a side elevation view illustrating the cutter assembly with the cutter bit member and retainer member of the present invention in the installed position thereof.

Referring again to the drawings in particular to FIGS. 1 and 2 thereof, there is illustrated the cutter bit assembly of the present invention, designated generally at 2, including the cutter bit member 4 for detachable mounting in a mounting block a member 6. As shown, the cutter bit member 4 includes a generally conically shaped nose portion 8 defined by a continuous conical side wall 5. The nose portion includes a carbon insert (carbide) C that is attached to the nose portion by brazing or the like. An elongated, reduced diameter cylindrical shank portion 10 is made integral with and extends outwardly from the nose portion and has a diameter so as to be as slidably received within the bore or socket provided in the mounting block member 6. The shank portion further includes an integral elongated reduced diameter hub portion 12 having an integral enlarged diameter retainer portion 14 that is adapted to project axially beyond the rear surface of the mounting block member so as to receive the retainer member 16 of the present invention.

As shown, the mounting block member 6 includes the axial bore 7 having an enlarged counter-sunk portion 11 at the front end and a reduced diameter outlet opening 13 at the rear end to slidably receive the hub portion 12 there through. In this form, the mounting block has a generally frustro-conical seat portion 15 to accommodate the generally correspondingly shaped annular groove 8 provided a conical nose portion 4 of the cutter bit, as disclosed in afore mentioned pending application Ser. No. 610,618.

In the invention, the cutter bit member 4 may be rotatably mounted in the bore of the mounting block via a wear sleeve member, as at S. This wear sleeve member is of the type disclosed in afore mentioned U.S. Pat. No. 4,201,421 and includes an elongated slit 9 to provide a resilient spring-action for frictionally retaining the cutter bit member within the mounting block during rotation of the cutter bit member relative to the mounting block, as known in the art.

Figure 3:
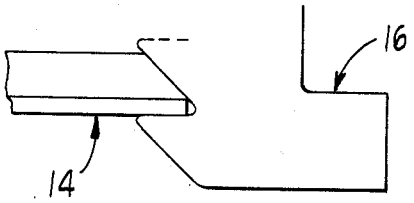
FIG. 3 is an end view, on an enlarged scale, of the retainer member of the present invention.
Figure 4:
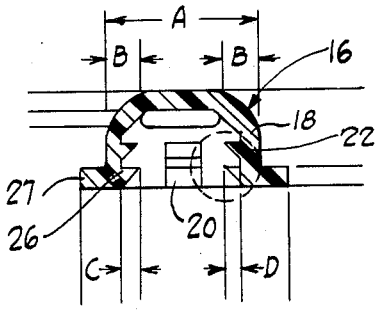
FIG. 4 is an enlarged, exploded view of the protuberance construction of the retainer member.
Figure 5:
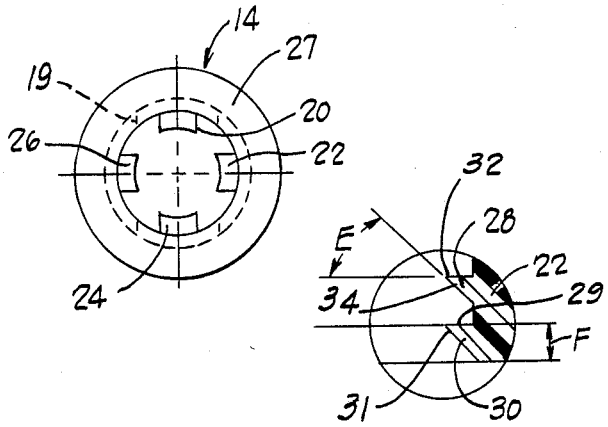
FIG. 5 is a vertical cross-sectional view of the retainer member made in accordance with the present invention.

Referring now to FIGS. 3 through 5, it will be seen that the retainer member 16 of the present invention has a hollow, cap-like body 18 defined by a generally annular cavity 19. The body terminates at its peripheral edge an outwardly extending integral flange portion 27 that extends generally parallel to the confronting rear surface of the mounting block 6 in the installed postion thereof. The retainer body includes a protuberance means in the form of a plurality of circumferentially spaced (FIG. 3) protuberance members 20, 22, 24 and 26 that extend radially inwardly in a direction toward the bit shank in the installed position. In the invention, it will be recognized that two or more protuberance members may be employed in accordance with the invention although four such members have been illustrated in a preferred embodiment. Each protuberance member includes one or more rib elements, as at 28 and 30, each having a base portion 29 and an apex portion 31 with the apex portion adapted to be sheard-off upon gripping engagement with the confronting surface of the shank portion, if desired. As best illustrated in FIGS. 3 and 4, the rib portions have an apex that terminates in a pointed terminal end and with the apex defined by a radial side wall 32 an inclined side wall 34 together defining an angle E of approximately 45°. Also, the cap-like body may have a diameter A of approximately 0.785" to 0.775", the dimension B being 0.393" to 0.388", the dimension C and D being 0.156" to 0.166". These dimensions are merely representative of a typical retainer member construction and are not deemed to be a limiting factor with the transverse dimension (diameter) between adjacent apex portions being approximately 0.443" to provide an adequate gripping engagement around the integral retainer ring portion of the shank bit.

Figure 6:
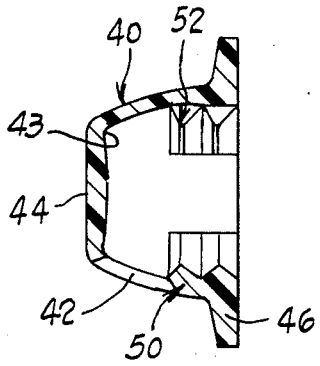
FIG. 6 is a vertical section view illustrating another modified form of the retainer member made in accordance with the present invention.
Figure 7:
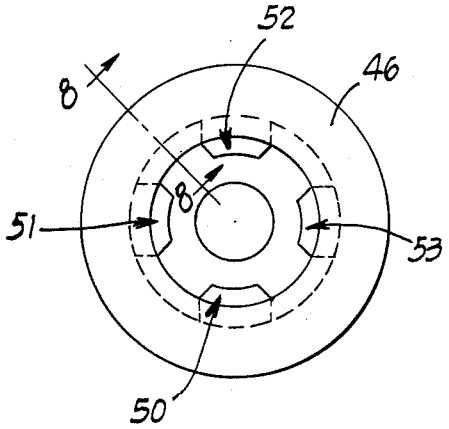
FIG. 7 is an end elevation view looking from the right hand side of FIG. 6.
Figure 8:
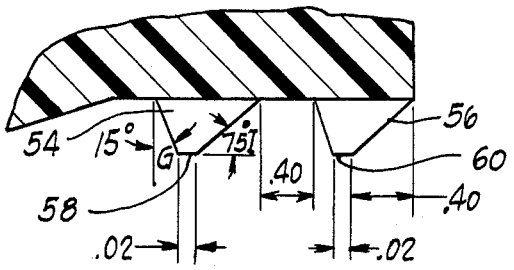
FIG. 8 is an enlarged, exploding the view of the protuberance structure of the retainer member made in accordance with the present invention.

In FIGS. 6, 7, 8 there is listed a modified form of the retainer member, designated generally at 40, made in accordance with the present invention. As illustrated, the retainer member 40 includes a cap-like body defined by an endless side wall of 42 but having a generally flattened top wall 44 so as to define a cavity 43 therein. Here again, the side wall 42 terminates in an endless peripheral outstanding flange portion 46 for engagement with the confronting rear surface of the mounting block, as aforesaid. In this form, a protuberance means is provided in the form of two or more protuberance members 50, 51, 52 and 53 that extend radially toward the bit shank. The protuberance members, in this form, each include a base portion 54, 56 and apex portions 58, 60 that may be of an arcuate (concave) configuration and an axial direction, as illustrated in FIG. 7. Here, the arcuate configuration provides a typed gripping frictional engagement with the confronting surfaces of the bit shank. Here, the apex portion is defined by a first inclined side wall and a second inclined side wall which are preferably disposed at angles F and G of 15° and 75° respectively. The second mentioned side wall is disposed at a greater angle of inclination as compared to the first mentioned side wall to facilitate axial insertion of the cap-like body or in around the terminal end portion of the bit shank.

In accordance with the invention, the retainer member is preferably made of an resilient, high strength polymeric material. In a preferred form, the polymeric material includes a synthetic nylon (plastic) material. Accordingly, the rib members have resiliency yet sufficient strength to yieldably snap-over the retainer ring member and yet provides sufficient holding power to prevent axial dislodgment of the bit shank from the mounting block in the installed position

We claim:

1. In a rotatable cutter bit system of the type for use with an excavating machine or the like comprising a mounting block member being adapted to be connected to a wheel means of an excavating machine, said mounting block member having an axial bore adapted to receive a cutter bit member therein, and a polymeric retainer member detachably connected to one end of said cutter bit member for restraining said cutter bit member against axial movement when the cutter bit member is installed within the bore of said mounting block member, said cutter bit member includes an enlarged, generally conical head portion and an elongated cylindrical shank portion, said shank portion being adapted for axial sliding movement within the bore of said mounting block member, said shank portion having an integral retaining ring portion at the terminal end thereof, said polymeric retainer member engageably coacting with said retaining ring portion to prevent axial shifting movement of said cutter bit member in the installed position thereof, said polymeric retainer member is of a unitary, generally hollow cap-like construction having internal protuberances adapted for gripping coacting engagement with said retainer ring member, said protuberance means extend radially inwardly out of the general plane of said housing adapted for contacting frictional engagement with the confronting surface of said retainer ring member, and said protuberance means include a plurality of circumferentially spaced gripping elements that extend radially inwardly in a direction toward the confronting surface of said retainer ring member having a radial dimension greater than the corresponding maximum transverse dimension of said retainer ring member for coacting gripping engagement with the confronting surface of said retaining ring member.

2. In a cutter bit system in accordance with claim 1, wherein said protuberance means include a plurality of thread-like elements having a base portion and an apex portion, said apex portion being adapted to be sheared away upon gripping coacting engagement with said retention means member.

3. In a cutter bit system in accordance with claim 2, wherein said apex portion terminates in a general flattened terminal end portion.

4. In a cutter bit system in accordance with claim 3, wherein said apex portion terminates in a pointed terminal end portion.

5. In a cutter bit system in accordance with claim 1, wherein said shank portion is adapted to detachably mount a cylindrical wear sleeve element, said wear sleeve element being restrained against axial movement by said retainer ring member and engageably coacting with the interior surface defined by the bore in said mounting block member to allow rotation of said cutter bit member relative to said mounting block member.

6. A cutter bit assembly of the type for use in excavating machines comprising a mounting block member having an axial bore extending therethrough and adapted for mounting on the wheel of an excavating machine, a cutter bit member having a generally conically shaped nose portion and an integral reduced diameter, cylindrical shank portion, said shank portin adapted to be slidabe within the bore in said cutter block member, and a retainer member made from a polymeric material adapted to be detachably connected to the terminal end of said shank portion for retaining the shank portion of said cutter bit member within the bore in said mounting block member in the installed position thereof, said retainer member is of a hollow, cap-like construction having internal protuberance means extending radially inwardly and adapted for gripping coacting engagement with the confronting surface of the terminal end of said shank portion, said protuberance means include two or more circumferentially disposed gripping portions, each of said gripping portions having individual thread-like elements having a base portion and an apex portion, and with the terminal end of said apex portion being adapted to be sheared away upon insertable engagement with the terminal end of said shank portion.

7. A cutter bit assembly in accordance with claim 6, wherein said apex portion terminates in a generally flattened terminal end portion.

8. A cutter bit assembly in accordance with claim 6, wherein said apex portion terminates in a pointed terminal end portion.

9. A cutter bit assembly in accordance with claim 6, wherein said shank portion is adapted to detachably mount a cylindrical wear sleeve element, said wear sleeve element being restrained against axial movement by said retainer ring member and engageably coacting with the interior surface defined by the bore in said mounting block member to allow rotation of said cutter bit member relative to said mounting block member.

10. A cutter bit assembly in accordance with claim 6, wherein said apex portion includes at least one inclined side wall that extends outwardly and angularly inwardly in a direction away from the terminal end of said shank portion.

11. In the rotatable cutter bit system of the type for use with an excavating machine or the like comprising a mounting block member adapted to be connected to a wheel means of an excavating machine, said mounting block member having an axial bore adapted to receive a cutter bit member therein, said cutter bit member having a generally conically shaped nose portion and an integral reduced diameter, cylindrical shank portion, said shank portion adapted to be slidably received within the bore in said cutter block member, a retainer member made from a polymeric material adapted to be detachably connected to the terminal end of said shank portion for retaining the shank portion of said cutter bit member within the bore in said mounting block member in the installed position thereof, said retainer member being of a hollow, cap-like construction having a plurality of internal protuberance means extending radially upwardly and adapted for gripping coacting engagement with the confronting surface adajcent the terminal end of said shank portion, each of said protuberance means including a plurality of circumferentially spaced gripping elements that extend radially inwardly in a direction toward the confronting surface of said shank portion and having a maximum radial transverse dimension less than the corresponding maximum transverse dimension through said shank portion to provide for said gripping coacting engagement with said shank portion in the installed position thereof.

12. In a rotatable cutter bit system in accordance with claim 11, wherein each of said gripping elements have a base portion and an apex portion, and the terminal end of said apex portion being resilient to enable said retainer member to snap-over the terminal end of said shank portion.

13. In a rotatable cutter bit system in accordance with claim 12, wherein said apex portion is defined by inclined side walls that extend convergently outwardly and inwardly toward one another away from said base portion.

14. In a rotatable cutter bit system in accordance with claim 11, wherein said polymeric material is nylon.

15. In a rotatable cutter bit system in accordance with claim 11, wherein said retainer member is made from a resilient polymeric material which enables the gripping portions to yieldably snap-over the maximum transverse dimension of the terminal end of said shank portion to reduce axial movement of said cutter bit in the installed position within said mounting block.

* * * * *